US006881246B2

(12) United States Patent
Totoki

(10) Patent No.: US 6,881,246 B2
(45) Date of Patent: Apr. 19, 2005

(54) COLLECTING DEVICE FOR SUSPENDED PARTICLES

(75) Inventor: Shinichiro Totoki, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 67 days.

(21) Appl. No.: 10/405,355

(22) Filed: Apr. 3, 2003

(65) Prior Publication Data

US 2003/0213366 A1 Nov. 20, 2003

(30) Foreign Application Priority Data

May 20, 2002 (JP) ..... 2002-143974

(51) Int. Cl.[7] ..... B03C 3/34

(52) U.S. Cl. ..... 96/26; 73/28.02; 73/864.71; 96/69; 96/75; 96/98; 96/413; 96/416; 209/127.1

(58) Field of Search ..... 96/57, 69, 75, 96/98, 26, 97, 416, 413; 95/69, 79; 209/127.1, 131; 73/28.02, 864.71

(56) References Cited

U.S. PATENT DOCUMENTS 1,605,648 A * 11/1926 Cooke ..... 95/79
1,849,198 A * 3/1932 Miller ..... 95/67
1,997,125 A * 4/1935 Soyez et al. ..... 209/710
3,473,118 A * 10/1969 Tassicker et al. ..... 324/722
3,493,109 A * 2/1970 Carta et al. ..... 209/11
3,853,750 A * 12/1974 Volsy ..... 209/127.1
4,041,768 A * 8/1977 Gibert et al. ..... 73/24.03
4,141,698 A * 2/1979 Kihlstedt et al. ..... 95/69
4,597,781 A * 7/1986 Spector ..... 96/52
4,725,294 A * 2/1988 Berger ..... 73/863.22
4,772,297 A * 9/1988 Anzai ..... 96/19
4,916,325 A * 4/1990 Rood et al. ..... 250/573
5,348,571 A * 9/1994 Weber ..... 96/68
5,442,190 A * 8/1995 Leck ..... 250/573
5,607,497 A * 3/1997 Brown ..... 73/864.71
5,885,330 A * 3/1999 Lee ..... 95/69
5,888,276 A * 3/1999 Price et al. ..... 96/17
5,938,041 A * 8/1999 Stencel et al. ..... 209/127.4
5,938,823 A * 8/1999 Condit et al. ..... 96/16
5,944,875 A * 8/1999 Stencel et al. ..... 95/57
5,980,614 A * 11/1999 Loreth et al. ..... 96/63
6,004,375 A * 12/1999 Gutsch et al. ..... 95/57
6,005,662 A * 12/1999 Ence ..... 356/338
6,187,271 B1 * 2/2001 Lee et al. ..... 422/121
6,230,551 B1 * 5/2001 Burniston ..... 73/61.73
6,252,658 B1 * 6/2001 Togawa et al. ..... 356/335
6,372,506 B1 * 4/2002 Norton ..... 436/63
6,585,803 B1 * 7/2003 Chang et al. ..... 95/70
6,589,314 B1 * 7/2003 Page et al. ..... 95/32
6,674,528 B1 * 1/2004 Adachi et al. ..... 356/336
6,807,874 B1 * 10/2004 Totoki ..... 73/864.71
2003/0200787 A1 * 10/2003 Totoki ..... 73/28.04

* cited by examiner

*Primary Examiner*—Richard L. Chiesa
(74) *Attorney, Agent, or Firm*—Manabu Kanesaka

(57) ABSTRACT

A collecting device for collecting suspended particles includes a mobility analysis device; a collecting container connected to an outlet of the mobility analysis device; a discharge electrode disposed inside the collecting container for charging the particles inside the collecting container by generating single polar ions; and a collecting electrode for collecting the charged particles inside the collecting container by an electric potential difference relative to the discharge electrode. In the mobility analysis device, the particles are charged and guided into a flow path. An electric field is created in the flow path, and the particles are guided into the path perpendicular to the electric field. Since a mobility of a particle in an electric field depends on a size of the particle, the particles guided in the path are separated according to the electric field, thereby obtaining particles with sizes in a specific range.

6 Claims, 1 Drawing Sheet

COLLECTING DEVICE FOR SUSPENDED PARTICLES

BACKGROUND OF THE INVENTION AND RELATED ART STATEMENT

The present invention relates to a collecting device for suspended particles.

For collecting particles suspended in a gas such as the atmosphere, a conventional method wherein a gas is sucked to pass through a filter so that particles in the gas are collected has been used widely.

The inventor has proposed a device for collecting suspended particles in the atmosphere. The device includes a collecting container for sucking the atmosphere therein with a pump; a discharge electrode for generating single polar ions inside the collecting container; and a collecting electrode having a potential difference relative to the discharge electrode. The collecting device charges the particles suspended in the atmosphere sucked inside the collecting container, thereby collecting the particles on the collecting electrode.

In the conventional method of collecting the particles suspended in the gas using the filter, it is difficult to extract the collected particles from the filter. When a microscope is used to observe the particles, the observation has to be performed on the filter. In that case, it is difficult to observe the particles because images of the particles become a blur due to the filter as a background. Further, when the collected particles are subjected to chemical analysis with various types of analytical instruments, it is substantially impossible to analyze the collected particles because it is difficult to separate an individual particle from the filter.

The proposed device can extract each particle easily because the particles are collected on a surface of the collecting electrode. Thus, it is easier to use various types of analytical instruments for the chemical analysis. Also, when the collecting electrode is formed of a transparent material, the microscope can be used to observe the collected particles directly, thereby obtaining clear images of the particles. However, the proposed device collects all the particles in the gas, and can not selectively collect particles with diameters in a specific range.

An object of the present invention is to provide a device for selectively and efficiently collecting particles suspended in the gas according to particle diameters in a desired range. Therefore, it is easy to observe the collected particles by a microscope, and to extract an individual particle for various types of analyses and measurement of a particle size distribution.

Further objects and advantages of the invention will be apparent from the following description of the invention.

SUMMARY OF THE INVENTION

In order to achieve the above-mentioned objectives, a collecting device for collecting suspended particles of the present invention includes a mobility analysis device; a collecting container connected to an outlet of the mobility analysis device; a discharge electrode disposed inside the collecting container for charging the particles inside the collecting container by generating single polar ions; and a collecting electrode for collecting the charged particles inside the collecting container by a potential difference relative to the discharge electrode. In the mobility analysis device, the particles in the atmosphere are charged and guided into a flow path along with the atmosphere. An electric field is created in the flow path, and the particles are guided into the path perpendicular to the electric field. Since a mobility of a particle in an electric field depends on a size of the particle, the particles guided in the path are separated according to the electric field, thereby obtaining particles with sizes in a specific range.

According to the present invention, the suspended particles are charged, and the collecting device collects the charged particles in the collecting electrode by means of the potential difference. In addition, a separation device based on the mobility analysis device is provided prior to the collecting device.

When the suspended particles in the gas are charged and moved inside the passage perpendicular to the electric field at a constant speed, force is acted upon the particles in the direction of the electric field and the particles move in the electric field direction at speeds according to the sizes thereof. Therefore, with a proper position and size of the passage, the particles passing through the passage exit have diameters only in a specific range according to an intensity of the electric field and the inflow speed of the particles in the passage. This type of device is publicly known as a mobility analysis device. Especially, when a device has a double cylinder structure and a passage is formed at a space between the two cylinders, the device is known as the differential mobility analyzer (DMA).

In the present invention, the collecting container is provided with a discharge electrode and a collecting electrode, and is connected to an outlet of the mobility analyzer. After being charged by the single polar ions from the discharge electrode, the particles are collected on the collecting electrode. Therefore, according to the present invention, the particles with the particle diameter only in a predetermined range can be collected effectively on the collecting electrode. Also, it is easy to extract the collected particles. Therefore, according to the invention, the particles with the particle diameters only in a specific range among all the particles suspended in the gas can be easily analyzed by various types of analytical instruments and be examined with a microscope.

DETAILED DESCRIPTION OF PREFERRED EMBODIMENTS

Figure 1:
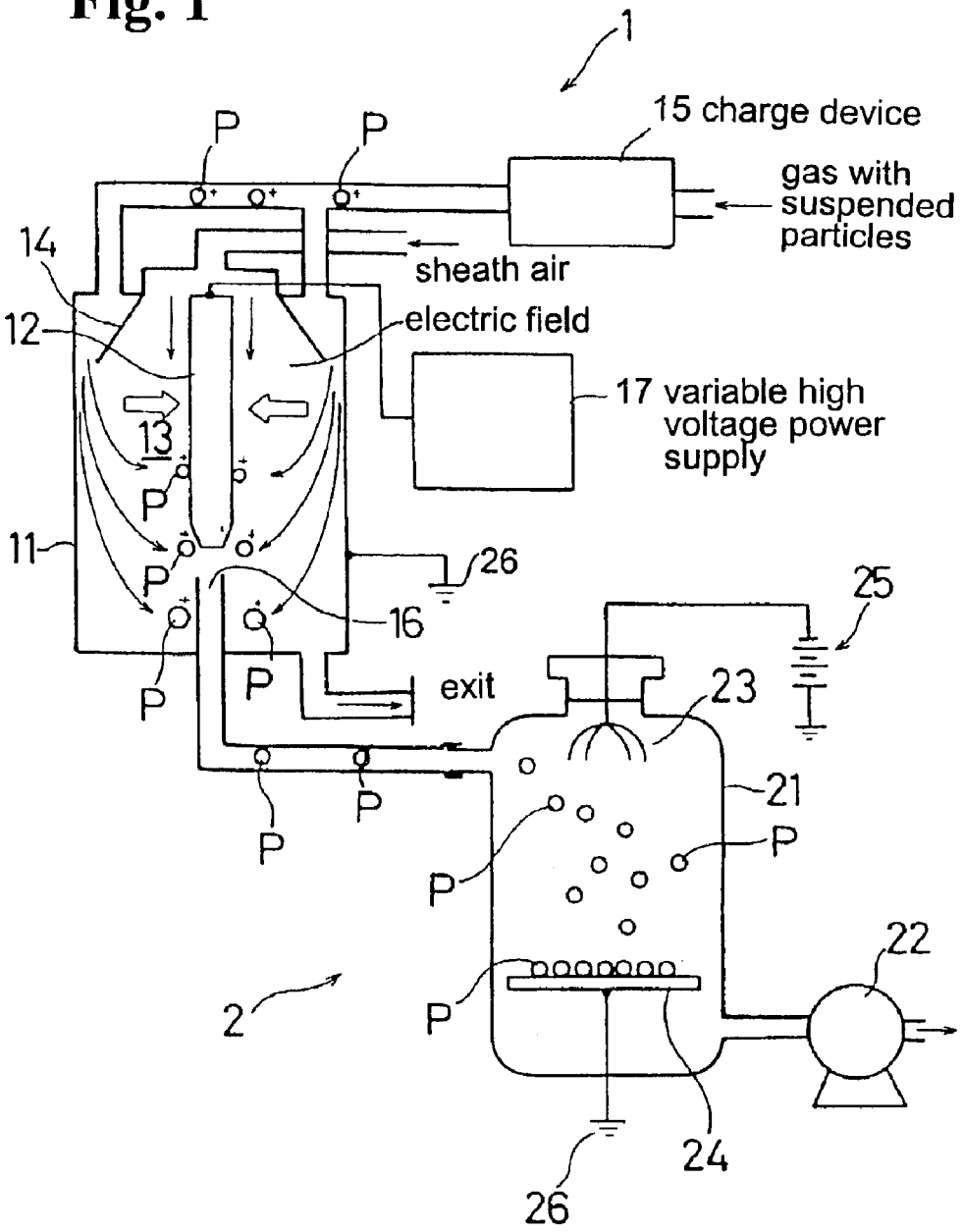
FIG. 1 is a diagram showing a configuration of an embodiment according to the present invention.

Hereunder, embodiments of the present invention will be described with reference to the accompanying drawing. FIG. 1 is a diagram showing a configuration of the preferred embodiment of the invention.

An electrode 12 constructing an inside cylinder is disposed along a shaft center inside an outside cylinder 11. A space between the electrode 12 and the outside cylinder 11 forms a passage 13 for flowing charged particles P and a gas.

A conical guide plate 14 is disposed at an upper end of the outside cylinder 11, so that clean sheath air A flows inside the guide plate 14. A charge device 15 supplies the gas including the suspended particles P through outside the guide plate 14. Also, a passage exit 16 formed of a narrow tube is provided at a lower end of the outside cylinder 1. The electrode 12 is connected to a variable high-voltage power supply 17 so that a specific negative high voltage can be applied to the electrode. The outside cylinder 11 is connected to an earth potential 26.

The differential mobility analyzer (DMA) 1 is constructed with the configuration described above, so that the suspended particles P in the gas can be separated, and the particles with diameters only in a predetermined range can pass through the passage exit 16.

Namely, the suspended particles P are charged with a certain amount of electric charge by the electrified device 15, and move downward inside the passage 13 at a certain speed along the inner wall surface of the outside cylinder 11 as being drawn into the outside cylinder 11 through an outside of the guide plate 14. An electric field is formed in the passage 13 between the electrode 12 and the outside cylinder 11, so that a force toward the electrode 12 is applied to each particle P flowing perpendicular to the electric field. A moving speed of the charged particles in the electric field is a function of a size of a particle when the electric charge is the same. A particle with a smaller diameter moves faster. Accordingly, the particles P with small diameters flowing inside the passage 13 are pulled toward the electrode 12 and do not reach the passage exit 16. On the other hand, the particles P with large diameters are able to pass through the passage exit 16. Therefore, when a moving speed and the number of charges of the particles P are controlled to be constant, particles with diameters only in a certain range according to a voltage applied to the electrode 12 are guided to the passage exit 16.

The passage exit 16 of the differential mobility analyzer 1 communicates with a collecting container 21 of an electrostatic collecting device 2.

The electrostatic collecting device 2 includes the collecting container 21; a pump 22 for sucking the gas into the collecting container 21; a discharge electrode 23 and a collecting electrode 24 arranged inside the collecting container 21; and a high-voltage power supply 25 for applying a positive high voltage to the discharge electrode 23. The collecting electrode 24 is connected to the earth potential 26.

In the above-mentioned construction, when the high voltage is applied to the discharge electrode 23 while the pump 22 is driven, the single polar ions generated from ionization of the surrounding air move toward the collecting electrode 24 due to the potential difference relative to the collecting electrode 24. During that process, the single polar ions contact the particles P in the gas sucked inside the collecting container 21 to charge the particles P. The charged particles P are collected by the potential difference between the discharge electrode 23 and the collecting electrode 24 in a state that the particles are scattered randomly on the collecting electrode 24.

The differential mobility analyzer, 1 separates the particles P brought in the collecting container 21, so that the particles P with the diameters only in a specific range can be collected on the collecting electrode 24 by adjusting the applied voltage to the electrode 12 with the voltage variable high-voltage power supply 17.

Also, when the voltage of the high-voltage power supply 17 is changed sequentially, it is possible to collect groups of the particles P with various diameters.

In the particles P collected on the collecting electrode 24, each particle can be very easily extracted as compared to the case of using the conventional filter, so that various types of analytical instruments can be used for analyzing the particles. Also, when the collecting electrode 24 is formed of a glass plate or a transparent resin plate having a surface coated with a transparent electrode film, the particles P collected on the surface can be observed with a microscope to obtain a clear particle image without any effect of a background image. Thus, the shapes, number, and sizes of the particles P can be easily determined.

A total amount of the gas pulled into the collecting container 21 can be determined from a flowing rate of the pump 22 per unit time. Therefore, a concentration of the particles having diameters in a predetermined range in the gas can be calculated from an operating time of the device and the number of the particles P collected.

Furthermore, with the above-mentioned transparent electrode as the collecting electrode 24, it is possible to determine a particle size distribution of the particles P using a laser diffraction particle size analyzer. That is, when laser light irradiates on the particles, the laser diffraction particle size analyzer measures a spatial intensity distribution of diffraction and scattered light. From a result of the measurement, a particle size distribution of the particles is determined.

In the collecting device according to the present invention, with the transparent electrode as the collecting electrode 24, the particles P are collected in a randomly scattered state on the transparent collecting electrode 24. Therefore, it is possible to measure the spatial intensity distribution of the diffraction and scattered light from the particles P by irradiating the laser light while the particles P are collected on the collecting electrode 24. Further, in the size distribution measurement using laser diffraction particle size analyzer, it is possible to perform a wet type measurement, in which the laser light irradiates the particles P dispersed in a liquid medium. In such a case, a container made of a conductive material may be filled with the same liquid medium, and be placed on the collecting electrode 24, thereby collecting the particles P in the liquid medium.

The above-mentioned preferred embodiment may be used for collecting arbitrary particles. However, when the atmosphere is brought into the differential mobility analyzer 1, particles suspended in the atmosphere can be collected according to particle sizes for analysis or observation. For various types of commercially produced powder particles, particles with a diameter only in a specific range can be collected selectively. For example, with a semiconductor plate as the collecting electrode 24, various types of powder particles with the same particle diameter can be placed on the plate.

According to the present invention, the collecting container communicating with the passage exit is arranged adjacent to the differential mobility analyzer. In the differential mobility analyzer, the suspended particles with electric charge in the gas are guided into the passage perpendicular to the electric field thereof at a predetermined speed. The particles with sizes only in a predetermined range pass through the passage exit according to the mobility difference based on the particle diameter. The collecting container includes the discharge electrode for generating the single polar ions to charge the particles flowing into the container, and the collecting electrode for attracting the charged particles through the potential difference relative to the discharge electrode. Thus, the particles with diameters only in a specific range classified by the mobility analyzer can be collected selectively on the collecting electrode. Moreover, the collected particles can be easily extracted from the collecting electrode, so that they can be analyzed by various types of analytical instruments and can be examined by the microscope.

Also, when the particles are collected while the mobility analyzer changes the target particle diameter, it is possible to collect sets of the particles with various diameters.

While the invention has been explained with the specific embodiments of the invention, the explanation is illustrative and the invention is limited only by the appended claims.

What is claimed is:

1. A collecting device for collecting particles suspended in a gas, comprising:

separating means for separating the particles in the gas according to sizes thereof having an exit, said separating means being a mobility analysis device including a first charging device for charging the particles in the gas, a flow path for flowing the particles with charges by the first charging device, and a second charging device situated in the flow path for providing electric field in the flow path perpendicular to a flow direction so that when the particles with electric charges enter the flow path at a predetermined speed, the particles are separated by moving difference based on the sizes, and the particles with sizes only in a specific range corresponding to an electric field intensity are collected at the exit, a collecting container connected to the exit of the separating means for receiving the particles separated in the separating means, a discharge electrode disposed in the collecting container for generating single polar ions, said particles introduced into the collecting container being charged with the single polar ions, and a collecting electrode disposed in the collecting container for collecting the charged particles through a potential difference relative to the discharge electrode.

2. A collecting device according to claim 1, wherein said mobility analysis device includes a container formed of a conductive material and electrically connected to an earth potential, an electrode as the second charging device disposed in the container for creating the electric field and forming the flow path between the container and the electrode, and a power supply for applying a voltage to the electrode.

3. A collecting device according to claim 2, wherein said mobility analysis device further includes a gas inlet for supplying a fresh gas without the particles into the container and a conical guide plate for guiding the gas containing the particles and the fresh gas effectively.

4. A collecting device for collecting particles suspended in a gas, comprising:

means for separating the particles in the gas according to sizes thereof having an exit, a collecting container connected to the exit of the separating means for receiving the particles separated in the separating means, a discharge electrode disposed in the collecting container for generating single polar ions, said particles introduced into the collecting container being charged with the single polar ions, and a collecting electrode disposed in the collecting container for collecting the charged particles through a potential difference relative to the discharge electrode, said collecting electrode being formed of a transparent material with a transparent conductive film coated thereon.

5. A collecting device according to claim 4, further comprising a pump connected to a side portion of the collecting container away from the collecting electrode for sucking gas in the collecting container.

6. A collecting device according to claim 5, wherein said collecting electrode is located under the discharge electrode.

* * * * *